US006564721B2

(12) United States Patent
Stiles

(10) Patent No.: US 6,564,721 B2
(45) Date of Patent: May 20, 2003

(54) RAIL TRANSPORT SYSTEM

(76) Inventor: Robert L. Stiles, 15322 Vermont St., Westminster, CA (US) 92683

( * ) Notice: Subject to any disclaimer, the term of this patent is extended or adjusted under 35 U.S.C. 154(b) by 0 days.

(21) Appl. No.: 10/067,598

(22) Filed: Feb. 7, 2002

(65) Prior Publication Data

US 2002/0134275 A1 Sep. 26, 2002

Related U.S. Application Data

(60) Provisional application No. 60/278,392, filed on Mar. 26, 2001.

(51) Int. Cl.[7] ..... E01B 25/00

(52) U.S. Cl. ..... 104/130.07; 104/124; 104/243

(58) Field of Search ..... 104/89, 94, 95, 104/123, 124, 125, 130.07, 242, 243, 245, 246, 247, 138.1; 105/154, 155

(56) References Cited

U.S. PATENT DOCUMENTS 4,620,486 A * 11/1986 Gronau et al. ..... 104/121
4,665,829 A * 5/1987 Anderson ..... 104/124
4,671,185 A * 6/1987 Anderson et al. ..... 104/130.07
5,275,111 A * 1/1994 Saviccevic ..... 104/121
5,456,183 A * 10/1995 Geldbaugh ..... 104/110
6,435,100 B1 * 8/2002 Henderson ..... 104/242

FOREIGN PATENT DOCUMENTS

JP 54-159912 * 12/1979

* cited by examiner

*Primary Examiner*—Mark T. Le
(74) *Attorney, Agent, or Firm*—Dennis W. Beech

(57) ABSTRACT

The rail transport system may generally be an elevated rail system that may be located along existing transportation right of ways such as roads, railroads, rivers, etc. While the system is generally structured for elevated roadways, it may also have surface or ground level elements. The system uses rail sections and rail switch sections having two load rail elements to carry automobile carrier cars and passenger cars. Guide rails are attached to the load rail elements by upstanding guide rail supports.

20 Claims, 5 Drawing Sheets

RAIL TRANSPORT SYSTEM

CROSS-REFERENCE TO RELATED APPLICATIONS

This application claims the benefit of U.S. Provisional Application Serial No. 60/278,392 filed Mar. 26, 2001.

BACKGROUND OF THE INVENTION

This invention relates to human and cargo transportation systems that operate on rail structures that may be elevated above the ground. The new rail transport system uses a four rail roadway structure that automobile carrier cars, cargo carrier cars and passenger cars may travel on at high speed controlled by sensors and computers. Individual automobiles, cargo and passengers may be transported on the system.

Currently available public and commercial forms of transportation systems in urban and associated developed suburban locations generally encourage the use of automobiles, trucks, buses and other forms of road transportation. There exists an extensive road system developed for internal combustion engine powered vehicle use. The problems with this system are well known. In high populated areas with dispersed residential housing, traffic congestion on expressways and city surface streets during peak commuter times is a common occurrence. This wastes time and fuel and causes pollution.

Alternatives to the automobile and bus may include subways and other forms of traditional rail commuter systems. These systems, as well as the bus systems, require the user to find transportation to a convenient transport stop to begin and end a trip. Such transport stops may be relatively frequent in a city center, but in the suburbs this is generally not the case. Also, travel on such systems during evening hours or other off peak use times may be considered dangerous by users as for example walking alone on deserted streets.

Use of rail and bus transportation systems also may involve increased transit time as such systems may stop numerous times at transport stops to take on and let off passengers. Also transfers from one transport route to others may be required in order to reach a particular destination. An additional negative public attitude concerning these forms of public transportation may be the lack of privacy as is offered by an automobile. Public transportation currently requires passengers to travel in multiperson cars that may be quite congested during rush hour commutes. Many individuals may have an aversion to traveling under such conditions.

Examples of point-to-point transportation systems may include taxi vehicles. In this instance a user may be picked up at a specific location, home, and transported to a second location. However, this form of transportation must use the roadway system and therefore will be degraded by congestion as discussed earlier. Also, taxi's are a relatively expensive form of transportation.

Another type of transport system is the personal rapid transit system. This system may use small vehicles that travel on narrow guide ways. The vehicles carry a small number of passengers non-stop between two stations. This system includes a number of improvements over existing systems; however, it lacks flexibility and may be susceptible to bottlenecks and system congestion that may be caused by passenger station capacity as well as other factors.

As can be seen, there is a need for a more efficient, user friendly rail transportation system that may incorporate use of existing systems such as the automotive roadway system.

SUMMARY OF THE INVENTION

One object of the present invention is a modular transportation system that may be efficiently constructed in existing urban/suburban environments. Another object is integration with existing transportation systems such as the automobile. A further object is movement of cargo as well as human passengers. Yet another object is movement of humans and cargo from a departure station to, a destination station without the need for intermediate stops. Yet a further object is movement of humans and cargo at relative high speeds of over 100 miles per hour during portions of transport.

These and other features, aspects and advantages of the present invention will become better understood with reference to the following drawings, description and claims.

DETAILED DESCRIPTION

The following detailed description is the best currently contemplated modes for carrying out the invention. The description is not to be taken in a limiting sense, but is made merely for the purpose of illustrating the general principles of the invention.

The rail transport system may generally be an elevated rail system that may be located along existing transportation right of ways such as roads, railroads and the like. The system may also have ground level elements. The system may have automobile carrier cars, cargo carrier cars and passenger cars operating thereon. Cars or vehicles and passengers may enter and exit the system at vehicle and passenger terminals. Cargo may be loaded at vehicle terminals. The cars operated on the rail transport system may have onboard sensors and control systems for safe operation with other cars and individual control of speed, location, route and braking as may be directed by an external block control system.

Figure 1:
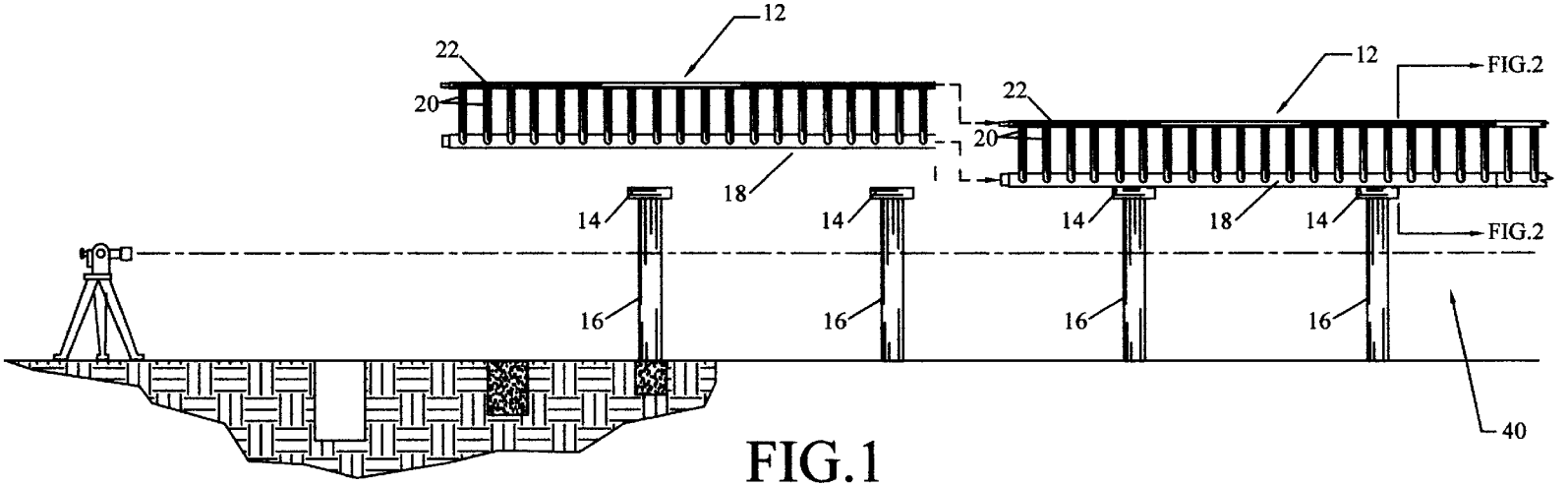
FIG. 1 illustrates a schematic view of a rail transport system railroad under construction.

Referring to FIG. 1, a rail transport system 10 may generally include rail sections 12 that are attached to column interface units 14 that are mounted on support columns 16 to form a railroad 40. The rail section 12 may have two load rail elements 18 with attached rail supports 20 supporting two guide rails 22. FIG. 1 illustrates the simple modular construction process for building a rail transport system 10 wherein ground footings are prepared, a column 16 is erected and an interface unit 14 is mounted thereon. A rail section 12 may then be attached and adjusted to mate with the adjoining rail section 12 and then may be secured by for example welding.

Figure 3:
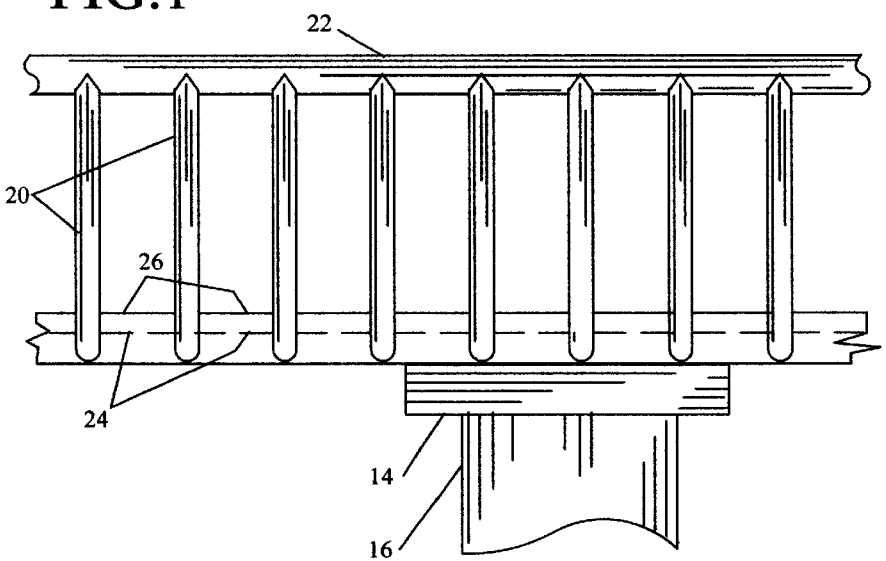
FIG. 3 illustrates a partial side elevation view of a rail section.
Figure 2:
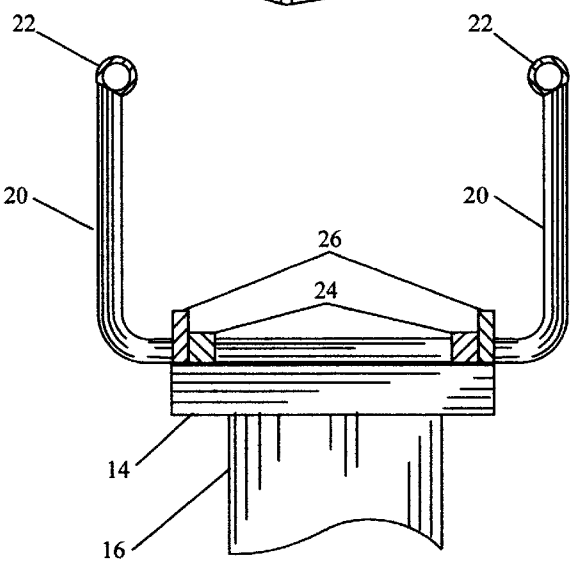
FIG. 2 illustrates an end elevation view of a rail section.

Referring to FIGS. 2 and 3, a rail section 12 may be attached and adjusted to a column interface unit 14 at load rail elements 18. Load rail elements 18 may include a load rail 24 extending upwardly therefrom to attach and support guide rails 22. The rail section 12 may be generally a four rail system.

Figure 4:
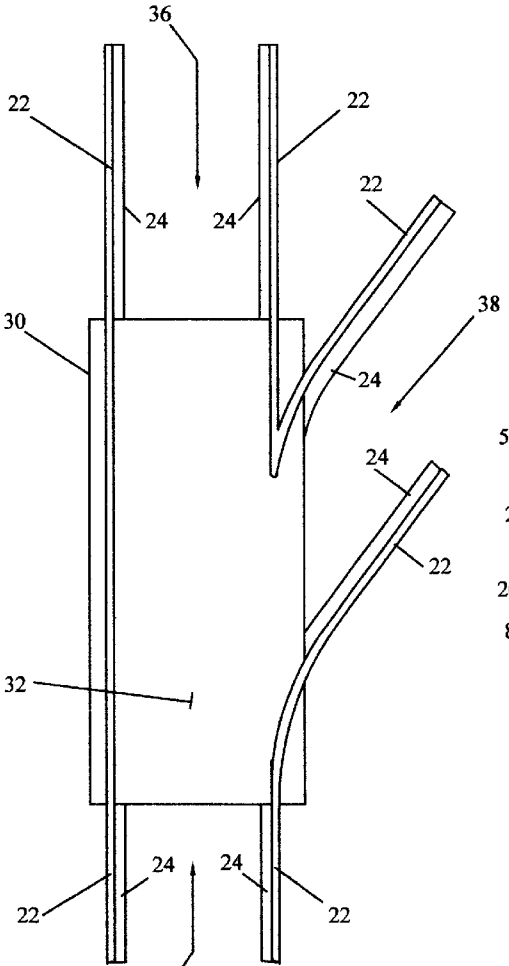
FIG. 4 illustrates a top plan view of a rail switch section.

Referring to FIG. 4, there may also be rail switch sections 30 to move cars from one track route to another track route, to a vehicle or cargo station, or to a passenger station. The switch section 30 allows transition from one route to another or merging from one route into another. A flat platform 32 may allow the wheels of a car to move from one route to a second route. The load rail 24, guide plate 26 and guide rail 22 may be interrupted at the switch interior portion 34. When a car merges from one route 36 into a second route 38 it may be necessary under computer control to synchronize speeds of cars to avoid collisions.

Figure 6:
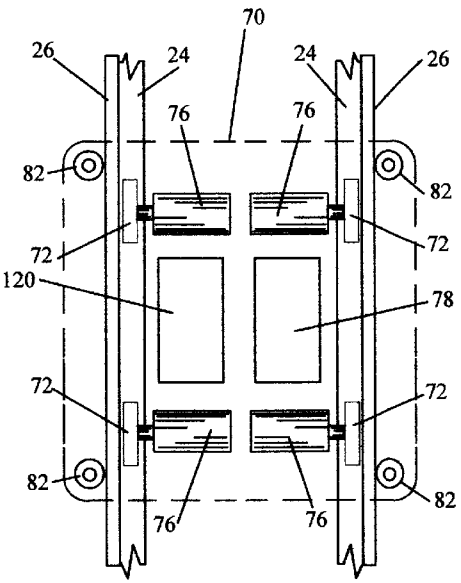
FIG. 6 illustrates a bottom view of propulsion assembly.
Figure 5:
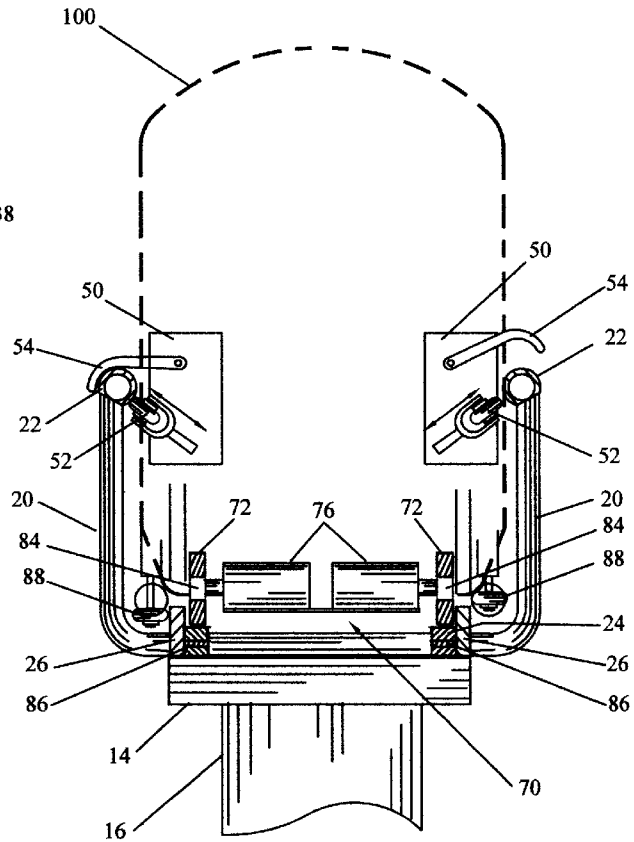
FIG. 5 illustrates a schematic end view of a passenger car and rail section.

Referring to FIGS. 5 and 6, the rail mechanism associated with a passenger car 100 may include guide rail assemblies 50 and propulsion assemblies 70. The guide rail assemblies 50 may include a guide wheel 52 for engagement with guide rails 22. The guide wheels 52 may engage the guide rail 22 at an angle below horizontal to dampen and control side to side oscillation due to high speed travel, to apply a vertical force element on the guide rail 22 to improve traction on load rails 24, and to inhibit the vehicle 100 being thrown off of the rails. A clamp arm 54 may be extended to engage the guide rail 22 to retain the passenger vehicle 100 in contact with the engaged guide rail 22. The clamp arm 54 may be retracted to a stowed position.

The propulsion assembly 70 may include rail wheels 72 on axles 74 with motors 76. The motors 76 may be electric powered and connected to power controller 78. Power controller 78 may be connected to a battery 80 and may be connected to an external power source (not shown). The lower guide wheels 82 may be in continuous contact with guide plates 26. The lower guide wheels 82 may also serve to stabilize the motion of rail wheels 72 on load rails 24. The propulsion assembly 70 may also include a computer 150.

The rail wheels 72 may have antivibration rubber compound inserts 84 for insulation and to reduce noise. The load rails 24 may also have antivibration pads 86 under the rails for insulation and to reduce noise. The rail wheels 72 have no taper and present a flat circumferential surface for traction on the rails.

To aid in switching between routes steering wheels 88 may be included in the propulsion assemblies 70. The steering wheels 88 may be lowered and raised for purposes of engaging the outside surface of guide plate 26 or disengagement therefrom. The steering wheels 88 may aid the propulsion assemblies 70 in maintaining position relative to the guide plate 26 as for example when transitioning a rail switch section or making a turn.

Referring to FIGS. 4 and 5, a passenger car 100 may transition a switch section 30 by engaging a clamp arm 54 and a steering wheel 88 as illustrated on the left side of FIG. 5. This may retain the passenger car 100 on the left side guide rail 22 and guide plate 26. The right side of the passenger car 100 has clamp arm 54 and steering wheel 88 disengaged allowing separation from guide rail 22 and guide plate 26. As viewed in FIG. 4 the result would be the passenger car 100 remaining adjacent to upper guide rail 22, the straight through guide rail, if the passenger car 100 were transitioning the switch section 30 from one end to the other.

Obviously, the proper use of the clamp arms 54 and steering wheels 88 may cause the passenger car 100 to remain adjacent to one guide rail 22 while disengaging from another guide rail 22. This may allow switching from one route to another or merging from one route into another. This system may allow for switching using only the passenger car 100 apparatus thereby requiring no active elements or apparatus to be included in rail switch sections 30.

Figure 7:
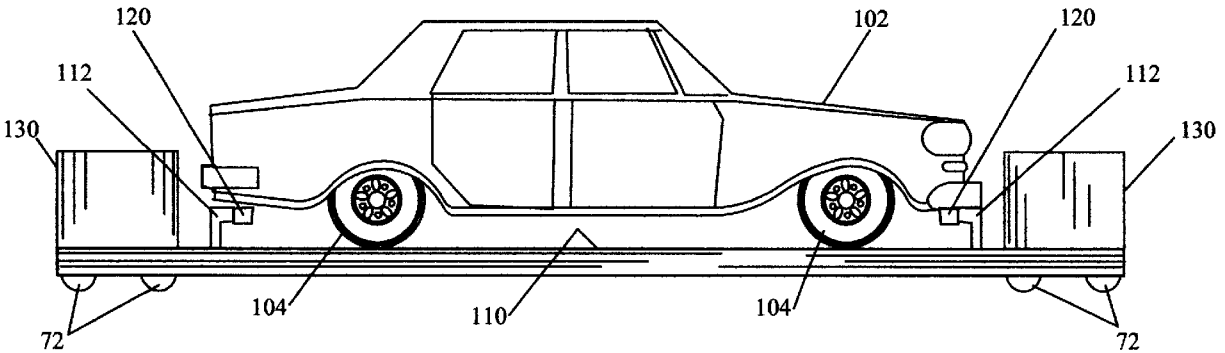
FIG. 7 illustrates a side elevation view of a carrier car and automobile.
Figure 8:
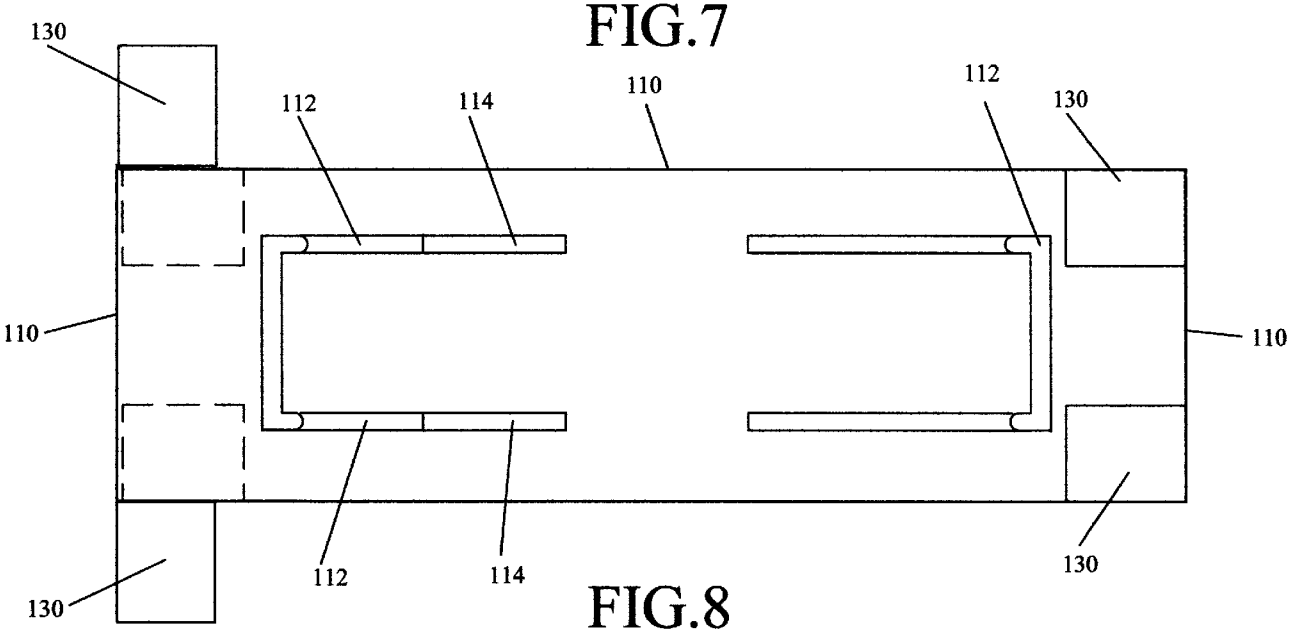
FIG. 8 illustrates a top plan view of a carrier car.

Referring to FIGS. 7 and 8, other cars may be used with the rail transport system 10. In this instance a carrier car 110 may transport automobiles 102 or small trucks on the rail system. The carrier car 110 may have car clamps 112 for engagement with receivers 120 attached to automobile 102. Guide rail assemblies 50 may be contained in movable posts 130. The clamps 112 may be lowered into slots 114 and the posts 130 rotated outwardly as illustrated on the left side of FIG. 8 to allow the entry of an automobile 102 onto the carrier car 110. The clamps 112 on the right side of FIG. 8 may be positioned to engage the receivers 120 at one end of the automobile 102. Once loaded, the second clamp 112 may be engaged with receivers 120 at the opposite end of the automobile 102 with the movable posts 130 rotated to a vertical position as indicated by the dashed lines. The carrier car 110 may then be ready for transport on the rail transport system 10.

Figure 9:
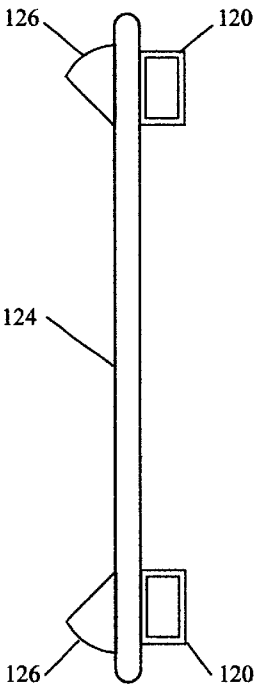
FIG. 9 illustrates a front elevation view of a hitch assembly for an automobile.

Referring to FIG. 9, the receivers 120 may be attached to a hitch assembly 122 having a cross bar 124 and attachment brackets 126 for ease of attachment to an automobile or other vehicle.

Figure 11:
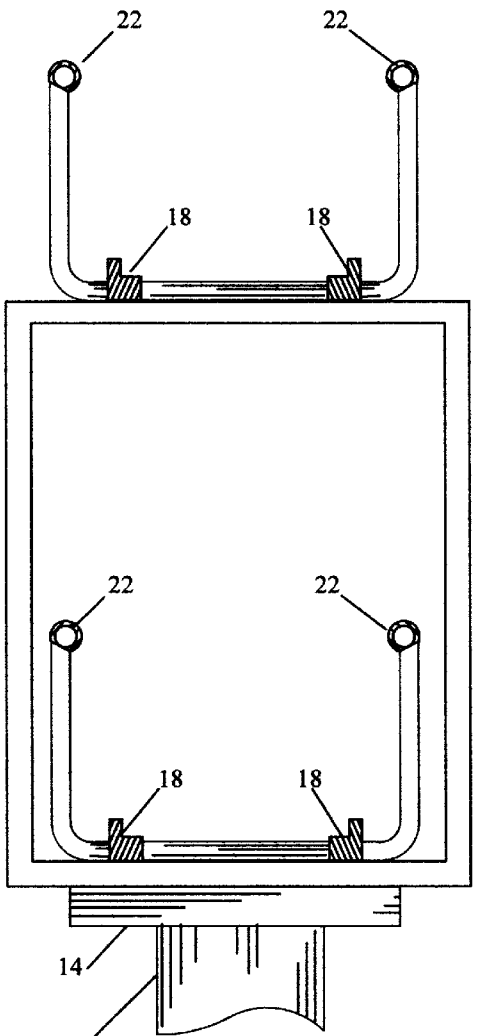
FIG. 11 illustrates an end elevation view of a dual roadway according to an embodiment of the invention.
Figure 10:
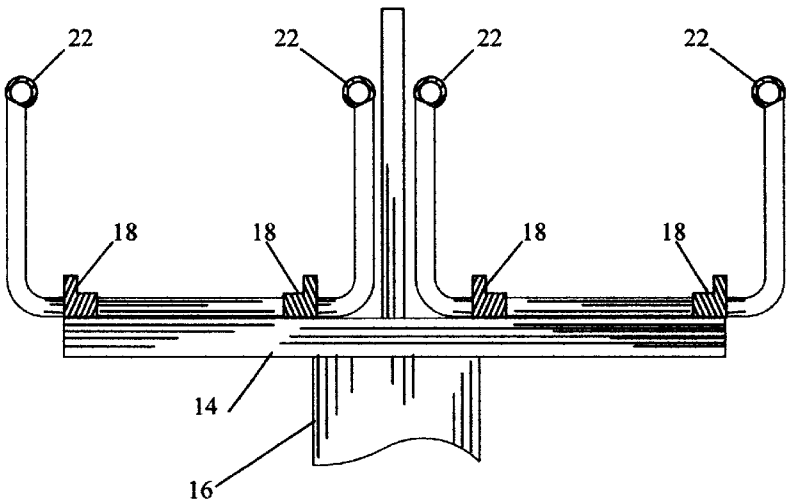
FIG. 10 illustrates an end elevation view of a dual roadway according to an embodiment of the invention.

As can be appreciated the carrier car may be modified to transport cargo as for example goods that are in a shipping container. While a single rail section rail transport system has been presented, other configurations may also be possible. Examples of two rail configurations are illustrated in FIGS. 10 and 11.

Figure 12:
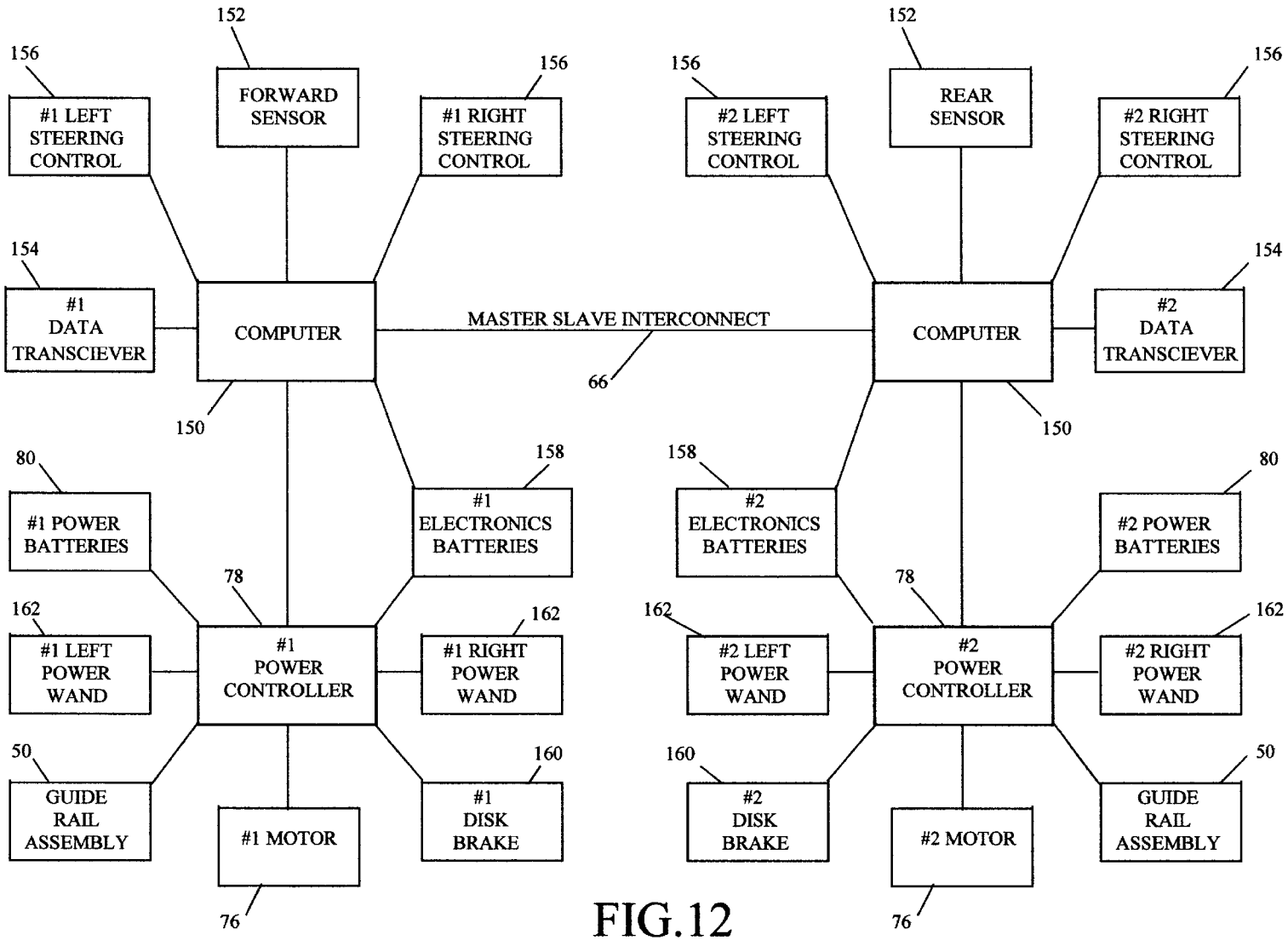
FIG. 12 illustrates a schematic of a computer control system according to an embodiment of the invention.

Referring to FIG. 12, the computer 150 of each propulsion assembly 70 on a car may be operated in a master-slave mode for added safety and redundancy. In this mode one computer 150 may control the operation with the second computer 150 as a backup unit. The computers 150 may be in communication with a sensor unit 152 to detect presence and distance from adjacent cars or other structures. The sensor unit 152 may be radar, infrared or like system for position determination. This may allow small separation distances between cars traveling at high speeds. Also data transceiver units 154 may be used for communication with facilities external to the car.

The computer 150 may also control the steering elements 156 and the power controller 78. The power controller 78 may control power transfer to the motors 76, battery 80 and electronics battery 158 and from a power wand 162. The power controller 78 may also control the guide rail assembly 50 operation, steering wheels 88 operation and the disk brake 160 actuation.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A rail transport system for use in transporting humans, automobiles and cargo from one location to another comprising:

a plurality of rail sections and a plurality of rail switch sections connected to form a railroad connecting a plurality of terminals;

each rail section and each rail switch section supported on a support column by attachment to a column interface unit attached to said support column;

each rail section having two load rails with two guide plates attached and positioned for transportation of a car;

a plurality of guide rail supports attached to each load rail and extending upwardly to support a guide rail;

each rail switch section having a flat platform defining a switch interior portion and having a first route and a second route;

said first route having a continuous guide rail and an interrupted guide rail wherein each of said guide rails having a plurality of guide rail supports, and having a pair of interrupted load rails;

said second route having a pair of guide rails with a plurality of guide rail supports merging with said interrupted guide rail said first route, and having a pair of load rails; and the guide rails of said sections and said first and second routes merging onto each other.

2. The rail transport system as in claim 1 further comprising:

a car having a plurality of guide rail assemblies and a plurality of propulsion assemblies;

said guide rail assembly comprising a guide wheel and a clamp arm; and said propulsion assembly comprising: a plurality of axles each with a rail wheel attached and driven by a motor; a power controller; a battery; and a plurality of lower guide wheels.

3. The rail transport system as in claim 2 wherein said rail wheels having a centrally disposed rubber compound insert and said load rails having a rubber compound pad thereunder.

4. The rail transport system as in claim 2 wherein said propulsion assemblies having a plurality of steering wheels.

5. The rail transport system as in claim 2 wherein said car is a passenger car.

6. The rail transport system as in claim 2 wherein said car is a carrier car.

7. The rail transport system as in claim 6 wherein said carrier car having slots formed therein into which a pair of car clamps are mounted and having a plurality of movable posts.

8. The rail transport system as in claim 7 wherein said movable posts contain said guide rail assembly.

9. The rail transport system as in claim 2 wherein said propulsion assembly having a computer in communication with said power controller.

10. The rail transport system as in claim 9 wherein a first computer of a first propulsion assembly is in communication with a second computer of a second propulsion assembly and said computers are operated in a master-slave mode.

11. The rail transport system as in claim 10 wherein said computer is in communication with a sensor, a data transceiver unit and an electronics battery.

12. A rail transport system for use in transporting humans, automobiles and cargo from one location to another comprising:

a plurality of rail sections and a plurality of rail switch sections connected to form a railroad connecting a plurality of terminals;

each rail section and each rail switch section supported on a support column by attachment to a column interface unit attached to said support column;

each rail section having two load rails and two guide plates positioned for transportation of a car;

a plurality of guide rail supports attached to each load rail and extending upwardly to support a guide rail;

each rail switch section having a flat platform defining a switch interior portion and having a first route and a second route;

said first route having a continuous guide rail and an interrupted guide rail wherein each of said guide rails having a plurality of guide rail supports, and having a pair of interrupted load rails;

said second route having a pair of guide rails with a plurality of guide rail supports merging with said interrupted guide rail of said first route, and having a pair of load rails;

the guide rails of said rail sections and said first and second routes merging onto each other;

a car having a plurality of guide rail assemblies and a plurality of propulsion assemblies;

said guide rail assembly comprising a guide wheel and a clamp arm; and said propulsion assembly comprising: a plurality of axles each with a rail wheel attached and driven by a motor; a power controller; a battery and a plurality of lower guide wheels.

13. The rail transport system as in claim 12 wherein said rail wheels having a centrally disposed rubber compound insert and said load rails having a rubber compound pad thereunder.

14. The rail transport system as in claim 12 wherein said propulsion assemblies having a plurality of steering wheels.

15. The rail transport system as in claim 12 wherein said propulsion assembly having a computer in communication with said power controller.

16. The rail transport system as in claim 15 wherein a first computer of a first propulsion assembly is in communication with a second computer of a second propulsion assembly and said computers are operated in a master-slave mode.

17. The rail transport system as in claim 15 wherein said computer is in communication with a sensor, a data transceiver unit and an electronics battery.

18. A rail transport system for use in transporting humans and cargo from one location to another comprising:

a plurality of rail sections and a plurality of rail switch sections connected to form a railroad connecting a plurality of terminals;

each rail section and each rail switch section supported on a support column by attachment to a column interface unit attached to said support column;

each rail section having two load rails and two guide plates positioned for transportation of a car;

a plurality of guide rail supports attached to each load rail and extending upwardly to support a guide rail;

each rail switch section having a flat platform defining a switch interior portion and having a first route and a second route;

said first route having a continuous guide rail and an interrupted guide rail wherein each of said guide rails having a plurality of guide rail supports, and having a pair of interrupted load rails;

said second route having a pair of guide rails with a plurality of guide rail supports merging with said interrupted guide rail of said first route, and having a pair of load rails; and the guide rails of said rail sections and said first and second routes merging onto each other;

a car having a plurality of guide rail assemblies and a plurality of propulsion assemblies;

said guide rail assembly comprising a guide wheel and a clamp arm;

said propulsion assembly comprising: a plurality of axles each with a rail wheel attached and driven by a motor; a power controller; a battery and a plurality of lower guide wheels;

said rail wheels having a centrally disposed rubber compound insert and said load rails having a rubber compound pad thereunder;

said propulsion assemblies having a plurality of steering wheels;

said propulsion assembly having a computer in communication with said power controller; and said computer is in communication with a sensor, a data transceiver unit and an electronics battery.

19. The rail transport system as in claim 18 wherein a first computer of a first propulsion assembly is in communication with a second computer of a second propulsion assembly and said computers are operated in a master-slave mode.

20. The rail transport system as in claim 7 wherein there is a receiver attached to a hitch assembly having a cross bar and a plurality of attachment brackets that may be engageable by said car clamps.

* * * * *